US008415574B2

(12) United States Patent
McCoy et al.

(10) Patent No.: US 8,415,574 B2
(45) Date of Patent: Apr. 9, 2013

(54) MULTI-POLE HANDLE LOCK FOR CIRCUIT BREAKERS

(75) Inventors: Brian Timothy McCoy, Lawrenceville, GA (US); John D. Stephenson, Roswell, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 606 days.

(21) Appl. No.: 12/388,080

(22) Filed: Feb. 18, 2009

(65) Prior Publication Data

US 2009/0211883 A1 Aug. 27, 2009

Related U.S. Application Data

(60) Provisional application No. 61/030,315, filed on Feb. 21, 2008.

(51) Int. Cl.
*H01H 9/28* (2006.01)

(52) U.S. Cl. ..... 200/43.14; 200/50.32

(58) Field of Classification Search ..... 200/43.19, 200/43.14–43.15, 50.32, 50.35, 5 B
See application file for complete search history.

(56) References Cited

U.S. PATENT DOCUMENTS

| | | | | |
|---|---|---|---|---|
| 3,312,794 | A | 4/1967 | Hollyday | |
| 6,472,619 | B1 * | 10/2002 | Halphide | 200/43.16 |
| 6,552,286 | B2 * | 4/2003 | Yang et al. | 200/50.32 |
| 6,743,987 | B1 | 6/2004 | Jurgens | |
| 7,355,133 | B2 * | 4/2008 | McCoy | 200/50.11 |
| 2002/0158734 | A1 | 10/2002 | Ter-Hsiang | |
| 2004/0099514 | A1 | 5/2004 | McCoy | |

* cited by examiner

*Primary Examiner* — Felix O Figueroa

(57) ABSTRACT

A multi-pole handle lock having a base plate and movable locking plate assembly that is adapted to mount on to at least two circuit breakers. A handle restrictor plate is mounted on the base plate for translational movement while maintaining the circuit breaker handles in the same position as each other. The handle restrictor plate allows each handle to independently move to the tripped position, while allowing the restricted circuit breakers to operate as a logical group. The low profile of the plates, allows visual inspection of the handle ends to determine their tie status.

19 Claims, 4 Drawing Sheets

MULTI-POLE HANDLE LOCK FOR CIRCUIT BREAKERS

RELATED APPLICATION INFORMATION

This application claims priority to provisional application Ser. No. 61/030,315 filed on Feb. 21, 2008 the contents of which are incorporated herein by reference thereto.

BACKGROUND

1. Technical Field

This disclosure relates generally to the field of electrical circuit breakers and more particularly to a multi-pole handle lock with same position handle control.

2. Description of the Related Art

In general, circuit breakers are employed to selectively engage a branch circuit to an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts is supported by a pivoting contact arm while the other operating contact is substantially stationary. The contact arm is pivoted by an operating mechanism such that the movable contact supported by the contact arm can be engaged and disengaged from the stationary contact.

There are several ways by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism; or auxiliary devices can be used to trip the circuit breaker thereby moving the movable contact. For many circuit breakers, the operating handle is coupled to the operating mechanism such that when the tripping mechanism activates the operating mechanism to separate the contacts, the operating handle moves to a fault or tripped position.

In multi-pole applications, like 220-240V branch circuits, two circuit breakers are combined together into a single unit. The combined unit is referred to as a single two pole breaker. Single multi-pole breakers incorporate "common trip", which insures that when 1 pole trips, all of the other poles are tripped as well. Thus an overcurrent condition in any one pole will actuate a common tripping mechanism and shut off power to the entire multi-pole branch circuit. It is common practice within the industry to have an external handle tie attached across the handles of multi-pole breakers. Accordingly, the presence of the handle tie provides a visual indication that the handles are part of a combined unit having a common trip.

Handle locks are devices that can be installed on one or more circuit breakers to lock them in the on or off position, and prevent unauthorized switching. A problem arises when locking multiple handles all in the same position. Some devices that engage the handles so resembles an OEM traditional handle tie that it could give the erroneous illusion that the locked breakers are part of a single unit featuring a common trip. Accordingly, there is a need for a handle lock which allows same position locking of multiple breakers without visually blocking the free ends of the handles.

SUMMARY OF THE INVENTION

A multi pole handle lock for securing at least two adjacent circuit breaker handles in the same position includes a base plate and a movable locking plate assembly that can be selectively disposed in a locked position. The assembly is adapted to mount on at least two circuit breakers and restrict the circuit breaker handles from moving between an on and off position. A handle restrictor plate is mounted for translational movement on said base plate and has at least two same position handle receiving windows. The handle restrictor plate has two terminal positions, in which the handle receiving windows are in registration with the on and off handle positions, respectively. When restricted to the on position, the windows include leeway to allow the handles to individually move into the tripped position.

The handle restrictor plate is adapted to allow at least two circuit breakers to be kept in the same on or off switch position. For circuit breakers in the on position, the handle receiving windows are configured and dimensioned to allow each handle to independently move into the tripped position. The locking plate is mounted to the base plate for pivotal movement between an open state in which the handles can be collectively switched on and off; and a closed state in which the base plate can be secured by locking a staple which extends through a hasp formed in the locking plate.

A multi pole handle lock in combination with at least two adjacent circuit breakers having sides, a pivot end and an opposed handle end. The base plate includes spaced mounting flanges which frictionally retain the circuit breakers on the pivot end and the opposed handle end. The mounting flanges of the base plate are sandwiched in place between the circuit panel cover and the circuit breakers. The multi-pole lock provides control over at least two independent single pole circuit breakers by removably ganging the handles together, and optionally locking the handles in an off position or a further position that includes the on position and the tripped position. The handle restrictor plate lies below the free end of the circuit breaker handles to provide a clear view of the handles tie status with respect to each other.

A method of controlling the handles of at least two independent circuit breakers including identifying at least two side-by-side independent circuit breakers that are to be operated as a logical group by mounting a base plate onto said at least two adjacent circuit breakers, wherein the base plate carries a handle restrictor plate that requires the handles to be set in the same position. Each handle is provided with adequate leeway in the handle restrictor plate to independently move from the on position to the tripped position. The handle restrictor plate is spaced from the free end of the handles to permit handle locking and to permit visual inspection of the handle tie status.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

Figure 1:
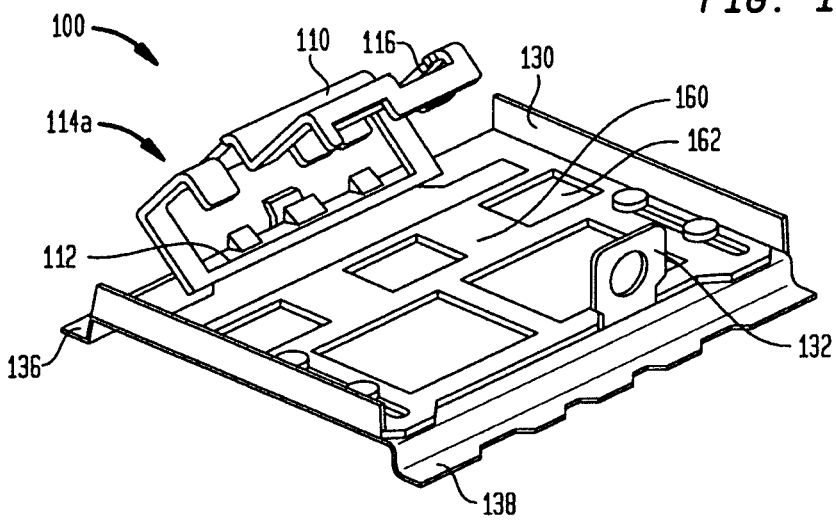
FIG. 1 is an isometric front view of a multi-pole handle lock in accordance with one illustrative embodiment.

The present invention provides devices and methods for selectively locking circuit breaker handles in the same position in one embodiment, the device of the present invention includes a multi-pole handle lock 100 having a movable locking plate 110, a base plate 130 and a handle restrictor plate 160. The handle restrictor plate 160 includes at least two same position handle receiving windows 162. The multi-pole handle lock 100 is adapted to mount on at least two adjacent circuit breakers. When mounted, the handle restrictor plate will maintain all circuit breaker handles in the same position. The locking plate 110 is movable from an open state 114*a* to a closed state 114*b* where it can be padlocked to keep the handles in their current position. The multi-pole handle lock 100 is configured and designed to allow circuit breakers that are "on" to move into the "tripped" position without interference. In addition, the multi-pole handle lock 100 is configured and designed to allow visual inspection of the handle ends to determine their tie status.

The present principles will be described in terms of single pole circuit breakers employed for residential applications. However, the embodiments described are not limited to the illustrative example and may be employed in other configurations for other applications. For example, the present principles are equally applicable to two or more pole mechanisms, breakers that include push to test features, any size breakers, multiple breaker systems in a single housing, etc. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those skilled in the art that the drawings presented herein represent conceptual views of illustrative system components embodying the principles of the invention. References to multi-pole include two poles or more than two poles. The drawings of a three one-pole assembly are illustrative of the concept which can be equally applied to two poles or more than two poles. While the drawings show 1 inch wide single breakers, the concepts herein are equally applicable to ½ inch wide breakers, with or without a handle tie and/or common trip. References to independent circuit breakers are shown as three separate 1 inch wide single pole circuit breakers. However, the concepts are equally applicable to any combination of two or more single pole, 2 pole, or more than 2 pole circuit breakers.

Figure 2:
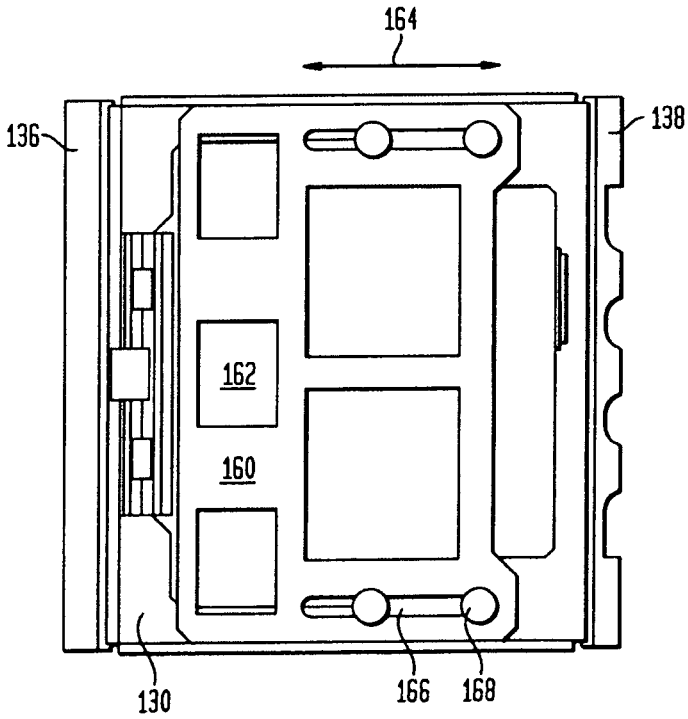
FIG. 2 is a top plan view thereof in accordance with one illustrative embodiment.

Referring now in specific detail to the drawings in which like reference numerals identify similar or Identical elements throughout the several views, and initially to FIG. 1, there is shown a multi-pole handle lock 100 having a movable locking plate 110, a base plate 130 and a handle restrictor plate 160. In one embodiment, the locking plate is pivotally mounted to base plate 130 with a hinge 112; and the handle restrictor plate 160 is slidably mounted to base plate 130 with slots 166 and pins 168, as shown in FIG. 2.

Figure 3A:
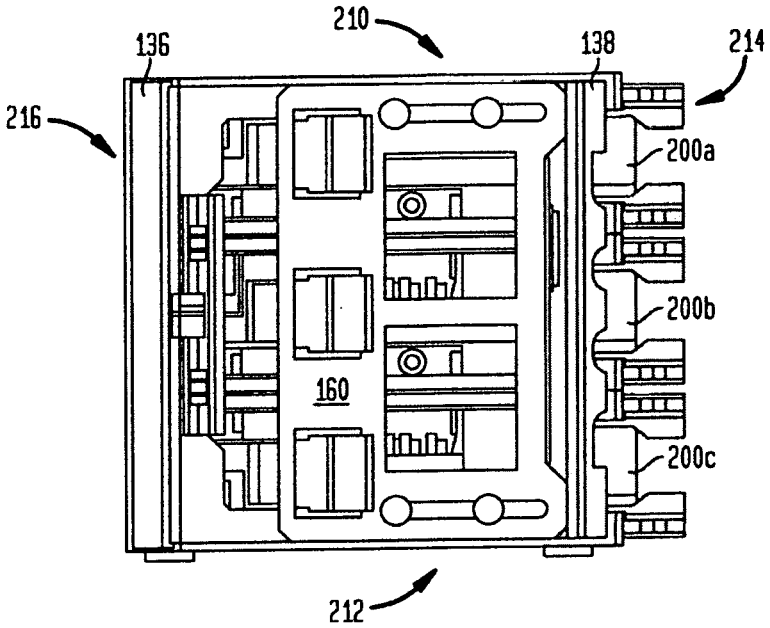
FIG. 3A is a top plan view of the handle lock installed on several circuit breakers in accordance with one illustrative embodiment.
Figure 3B:
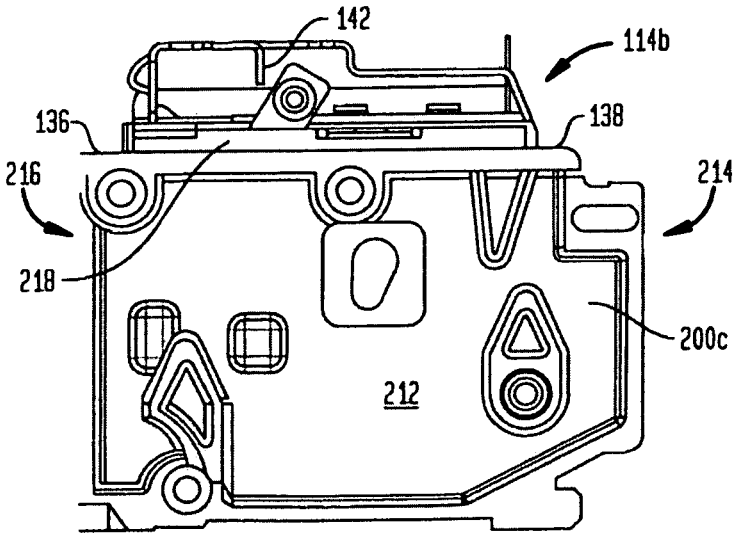
FIG. 3B is a side elevational view of FIG. 3A in accordance with one illustrative embodiment.
Figure 4A:
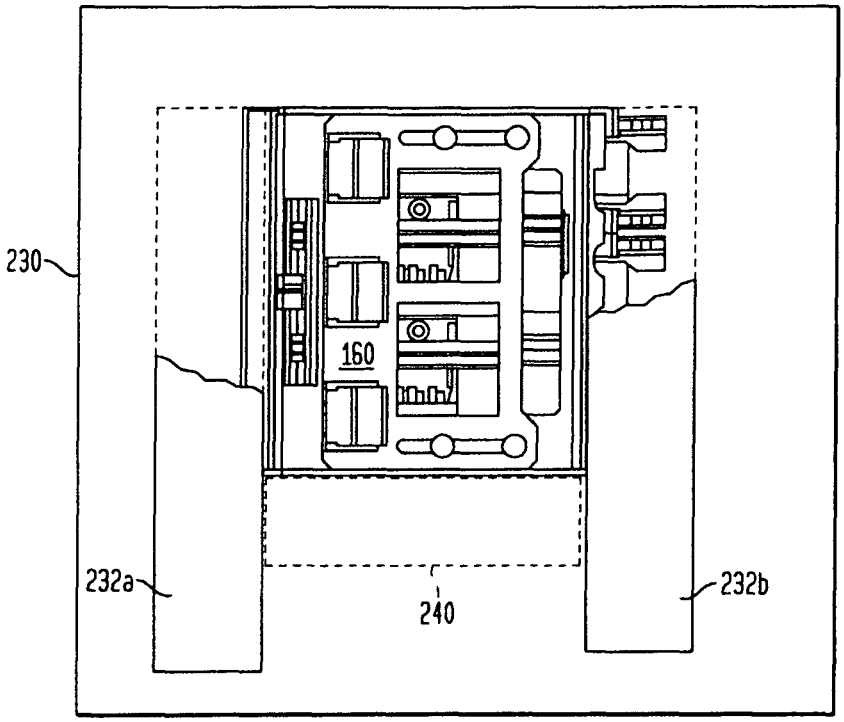
FIG. 4A is a top plan view of the handle lock and panel cover in accordance with one illustrative embodiment.
Figure 4B:
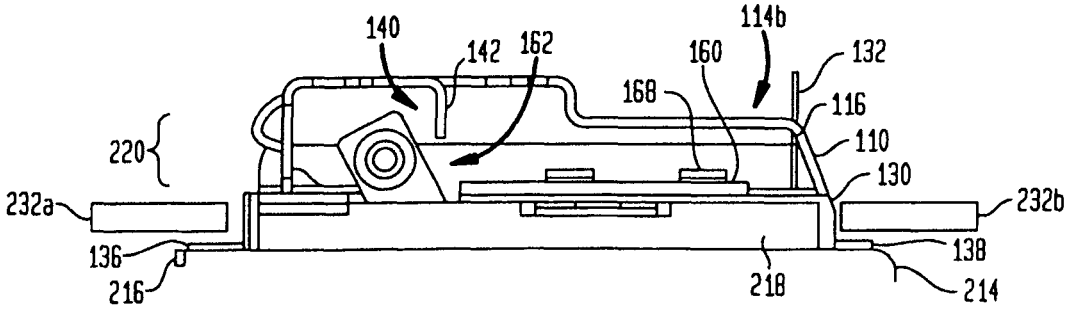
FIG. 4B is a side elevational view of FIG. 4A in accordance with one illustrative embodiment.

The multi-pole handle lock 100 is adapted to mount on 2, or more than 2, circuit breakers, where the circuit breakers are independent of each other, but may be of any type. The handle restrictor plate 160 is mounted for translational movement in one dimension 164 with respect to base plate 130. FIGS. 1, 3A and 3B show handle restrictor plate 160 in one terminal position, in which the handle receiving windows 162 will be in registration with the off handle positions of the circuit breakers. FIGS. 2, 4A and 4B show handle restrictor plate 160 in a second terminal position, in which the handle receiving windows 162 will be in registration with the on handle positions of the circuit breakers Handle restrictor plate includes slots 166 extending in the direction of the one dimension 164. Pins 168 are attached to the base plate and extend up through the slots. Slots 166 are slightly wider than the diameter of pins 168. The spacing of pins 168 and length of slots 166 are dimensioned and configured to allow handle receiving windows 162 to be in registration with the on and off handle positions. As will be understood by those skilled in the art, the pins may alternately be attached to the restrictor plate, with slots formed in the base plate. The restrictor plate and base plate may be equipped with interlocking rails and stops, to provide an equivalent sliding function. The restrictor plate may translate between its terminal positions by various other mechanical means, including linkages, and two-position attachment means. However, a sliding transition between the two terminal positions is preferred because it mimics a traditional handle tie function whereby switching of one handle is translated into a corresponding similar switching of the other handles.

Figure 5:
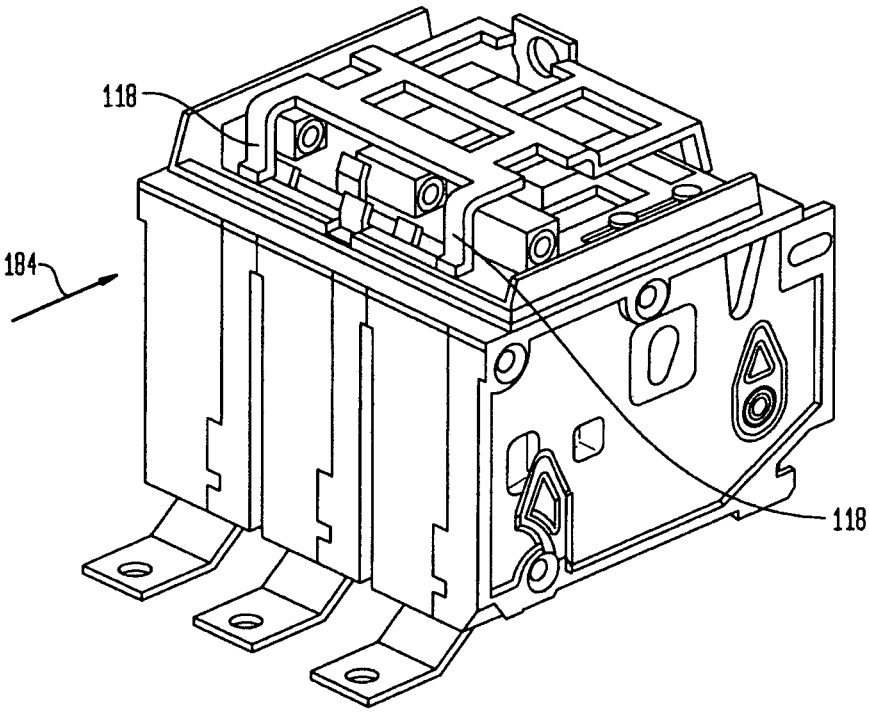
FIG. 5 is an isometric rear view with the locking plate closed in accordance with one illustrative embodiment.

Once the handle restrictor plate 160 is installed with all the handles being in the same position, locking plate 110 can be closed to maintain the handles in the current position. Locking plate may be configured to clip, slide, or plug in to its closed position. In one embodiment, a hinge 112 is provided between locking plate 110 and base plate 130, as shown in FIG. 1 in the open state 114*a*. FIGS. 3B, 4B and 5 shows locking plate 110 in its closed state 114*b*. In the closed state, a staple 132 (on base plate 130) is configured to pass through a hasp 116 (on locking plate 110) to allow a padlock or similar locking device to secure the assembly in its closed state 114*b*.

Referring now to FIGS. 3A and 3B, the multi-pole handle lock is shown installed on three adjacent circuit breakers 200*a*, 200*b* and 200*c*. Each circuit breaker has sides 210 and 212, a pivot end 214 and an opposed handle end 216. Base plate 130 is provided with downwardly extending mounting flanges 136 and 138 (see also FIGS. 1 and 2). In one embodiment, the flanges are configured as L shaped brackets. The flanges are spaced apart from each other a distance which is slightly narrower than the top switch plate 218 of the circuit breaker. In use, the handle lock 100 is mounted on the switch plate by a friction fit. FIG. 3A shows handle restrictor plate installed with three, single pole all in the off position (with locking plate 110 not shown for the sake of clarity). FIG. 3B shows the breakers locked in the off position, whereby tab 142 of locking plate 110 physically prevents the breaker from switching to the left, i.e. the on position.

As can be seen in FIGS. 4A and 4B, circuit breakers 200*a*, 200*b* and 200*c* have little or no clearance between them, on their sides 210 and 212. The handle lock 100 mounts to the pivot end 214 and the handle end 216 of the circuit breakers to avoid interference with other breakers or knock-outs that may be present in adjacent slot 240 within circuit breaker panel 230. After mounting of the handle lock 100, the panel cover is installed. Panel sections 232*a* and 232*b* (with knock-outs removed) sits outside the switch plate 218, thereby sandwiching the flanges 136 and 138 in place against the top face of the circuit breakers. Accordingly, the assembly 100 securely locks the handles in place as long as the panel cover remains installed.

FIG. 4B shows the assembly installed and in the closed position with the breaker switched on. Tab 142 and window 162 are configured to provide a gap 140, which allows leeway for the handle to move to the right into the tripped position. Accordingly, each handle within the assembly can independently move from the on position to the tripped position, without affecting the status of the other breakers. Following a breaker tripping, the locking plate 110 needs to be unlocked and opened, to move all breakers to the off "reset" position, before they can all be moved back to the on position.

A comparison of FIGS. 3A and 4A shows handle restrictor plate 160 in a breaker off terminal slot position (FIG. 3A); and a breaker on or tripped terminal slot position (FIG. 4A). The configuration of restrictor plate 160 provides that the handle receiving windows are in registration with the on and off handle positions, in correspondence with the terminal slot positions. This is achieved by forming cutouts in a blank plate. In the space extending from one slot to the other, there may be provided additional windows, divided by one or more webs. The additional windows may allow viewing of portions of the circuit breaker switch plate. The number of handle receiving windows can be set at two or more. While the slot-to-window configuration will remain basically constant, the side-to-side width of the handle lock can be extended to provide additional windows to accommodate any number of single or multi-pole breakers. Additional slot and pin mechanisms may be added on larger units.

As can be seen in FIGS. 4B and 5, base plate 130 and handle restrictor plate 160 have low profiles, where they are layered compactly against the switch plate. This arrangement leaves the handle ends 220 substantially exposed, while still tying their movement together. As mentioned above, the handle ends 220 are free to interact with tab 142 for locking purposes. In addition, locking plate 110 is designed with legs 118 extending up from the hinge that overlies the handles. In one embodiment, the legs overlie the two outer handles, in a three handle configuration. The space between the handles provides a clear view 184 to inspect the tie status of the breakers disposed under the assembly. More particularly, without being blocked by the addition of restrictor plate 160, the locking plate allows the space between adjacent handles to be clearly seen.

In another aspect of the invention, there is provided a method of controlling the handles of at least two independent circuit breakers. The invention can be used to logically group adjacent circuit breakers, for same position control. Accordingly, a group of branch circuits can be controlled together with single pole breakers. For example, if a group of office cubes is serviced by three adjacent single pole breakers, the invention can be utilized to keep all three circuits for the cubical group on. If the cubical group needs maintenance, all three breakers can be switched off together, and locked in the off position until the maintenance is completed. An overcurrent condition within the cubical group would trip a single breaker, with the others remaining on. If a single 3-pole breaker had been employed, the entire cubical group would have lost power due to the tripping of the one line.

Having described preferred embodiments for multi-pole handle locks for circuit breakers (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A multi pole handle lock for securing at least two adjacent circuit breaker handles of at least two circuit breakers in a same position comprising:

a base plate and a movable locking plate assembly that can be selectively disposed in a locked position, wherein the assembly is adapted to mount on the at least two circuit breakers and restrict the at least two adjacent circuit breaker handles from moving between an on and off position, the at least two adjacent circuit breaker handles being independent of each other; and a handle restrictor plate adapted to receive the at least two adjacent circuit breaker handles each set in the same position and adapted to allow each of the at least two adjacent circuit breaker handles to move from an on position to a tripped position independent of each other, the handle restrictor plate mounted to a planar portion of said base plate, the planar portion layered between the handle restrictor plate and top switch plates of the circuit breakers for translational movement on said base plate, wherein the planar portion of said base plate is parallel to and lies along the top switch plates, the handle restrictor plate having at least two same position handle receiving windows.

2. The multi pole handle lock of claim 1, wherein the handle restrictor plate can be translated in one dimension with respect to the base plate.

3. The multi pole handle lock of claim 2, wherein the handle restrictor plate is mounted for sliding movement on the base plate.

4. The multi pole handle lock of claim 3, wherein the handle restrictor plate includes slots extending in the direction of the one dimension, and wherein said multi pole handle lock further includes pins attached to the base plate which are slidingly received in the slots.

5. The multi pole handle lock of claim 3, wherein the handle restrictor plate has two terminal positions, in which the handle receiving windows are in registration with the on and off handle positions, respectively.

6. The multi pole handle lock of claim 1, wherein restricting the handles to the on position includes leeway to allow the handles to individually move into a tripped position.

7. The multi pole handle lock of claim 1, wherein the handle restrictor plate is adapted to allow at least two circuit breakers to be kept in the same on or off switch position.

8. The multi pole handle lock of claim 7, wherein for circuit breakers in the on position, the handle receiving windows are configured and dimensioned to allow each handle to independently move into a tripped position.

9. The multi pole handle lock of claim 8, wherein the locking plate is mounted to the base plate for pivotal movement between an open state in which the handles can be collectively switched on and off; and a closed state in which the base plate can be secured by locking a staple which extends through a hasp formed in the locking plate.

10. A multi pole handle lock in combination with at least two adjacent circuit breakers having sides, a pivot end and an opposed handle end comprising:

the at least two adjacent circuit breakers sitting side-by-side in an electrical panel having a cover, the at least two adjacent circuit breakers each having a circuit breaker handle independent of each other;

a base plate and a movable locking plate assembly that can be selectively disposed in a locked position, wherein the assembly mounts on the at least two circuit breakers and restricts the circuit breaker handles from moving between an on and off position; and a handle restrictor plate adapted to receive the circuit breaker handles each set in the same position and adapted to allow each of the circuit breaker handles to move from an on position to a tripped position independent of each other, the handle restrictor plate mounted to a planar portion of said base plate, the planar portion layered between the handle restrictor plate and top switch plates of the circuit breakers for translational movement on said base plate, wherein the planar portion of said base plate is parallel to and lies along the top switch plates, the handle restrictor plate having at least two same position handle receiving windows.

11. The combination of claim 10, wherein said base plate includes spaced mounting flanges which frictionally retain the circuit breakers on the pivot end and the opposed handle end.

12. The combination of claim 11, wherein the base plate is configured to avoid interference with the circuit panel cover.

13. The combination of claim 12, wherein the mounting flanges of the base plate are sandwiched in place between the circuit panel cover and the circuit breakers.

14. The combination of claim 10, wherein the multi-pole lock provides control over at least two independent single pole circuit breakers by removably ganging the handles together, and optionally locking the handles in an off position or a further position that includes the on position and a tripped position.

15. The combination of claim 10, wherein said handle restrictor plate ties the handles together so that manual movement of one handle from its existing position to a new position will displace the handle restrictor plate thereby translating all handle receiving windows to the new position.

16. The combination of claim 15, wherein the handle restrictor plate lies below the free end of the circuit breaker handles to provide a clear view of the handles tie status with respect to each other.

17. The combination of claim 16, wherein the handle receiving windows are configured and dimensioned to allow individual handles to move from the on position to a tripped position.

18. The combination of claim 17, wherein the locking plate is mounted to the base plate for pivotal movement between an open state in which the handles can be collectively switched on and off; and a closed state in which the base plate can be secured by locking a staple which extends through a hasp formed in the locking plate.

19. A multi pole handle lock for securing at least two adjacent circuit breaker handles of at least two circuit breakers in a same position comprising:

a base plate and a movable locking plate assembly that can be selectively disposed in a locked position, wherein the assembly is adapted to mount on the at least two circuit breakers and restrict the at least two adjacent circuit breaker handles from moving between an on and off position, the at least two adjacent circuit breaker handles being independent of each other, wherein said base plate has:

a plurality of pins attached thereto, spaced mounting flanges which frictionally retain the circuit breaker;

a handle restrictor plate adapted to receive the at least two adjacent circuit breaker handles each set in the same position and adapted to allow each of the at least two adjacent circuit breaker handles to move from an on position to a tripped position independent of each other, the handle restrictor plate mounted for translational movement in a first dimension on a planar portion of said base plate, the planar portion layered between the handle restrictor plate and top switch plates of the circuit breakers, wherein the planar portion is parallel to and lies along the top switch plates, the handle restrictor plate having:

a plurality of slots in a planar portion of the handle restrictor plate and extending in the direction of the first dimension, the plurality of slots parallel to the planar portion of the base plate and top switch plates, at least two same position handle receiving windows;

wherein the plurality of pins of the base plate are slidingly received by the plurality of slots of the handle restrictor plate; and wherein a spacing of the plurality of pins and a length of the plurality of slots are dimensioned and configured to allow the at least two same position handle receiving windows to be in registration with the on and off positions of the circuit breaker handles.

* * * * *